US007043779B2

(12) United States Patent
Mendenhall et al.

(10) Patent No.: US 7,043,779 B2
(45) Date of Patent: May 16, 2006

(54) TOP RAIL LOCK FOR PLAYYARD

(75) Inventors: Andrew Mendenhall, Indianapolis, IN (US); Michael C. Dorsey, Brownsburg, IN (US); Jason S. Andrews, Indianapolis, IN (US); James M. Kain, Troy, OH (US); Richard Glover, Greenwood, IN (US)

(73) Assignee: Cosco Management, Inc., Wilmington, DE (US)

( * ) Notice: Subject to any disclaimer, the term of this patent is extended or adjusted under 35 U.S.C. 154(b) by 379 days.

(21) Appl. No.: 10/353,378

(22) Filed: Jan. 29, 2003

(65) Prior Publication Data

US 2004/0198518 A1 Oct. 7, 2004

(51) Int. Cl.
*A47D 7/00* (2006.01)
*E05D 11/10* (2006.01)

(52) U.S. Cl. ..... 5/99.1; 16/324; 16/326; 403/102

(58) Field of Classification Search ..... 135/147, 135/151, 120.3; 5/99.1, 102, 100; 16/324, 16/326; 403/83, 84, 92, 93, 96, 97, 101, 403/102

See application file for complete search history.

(56) References Cited

U.S. PATENT DOCUMENTS 4,666,327 A * 5/1987 Su ..... 403/24
5,056,805 A * 10/1991 Wang ..... 280/47.36
5,349,709 A * 9/1994 Cheng ..... 5/93.1
5,377,368 A 1/1995 Cheng
5,381,570 A 1/1995 Cheng
5,504,951 A * 4/1996 Yeh ..... 5/99.1
5,542,151 A 8/1996 Stranski et al.
5,615,427 A * 4/1997 Huang ..... 5/99.1
5,617,592 A 4/1997 Cheng
5,761,754 A 6/1998 Cheng
6,123,091 A 9/2000 Flynn et al.
6,196,568 B1 * 3/2001 Stevens ..... 280/304.1
6,256,814 B1 7/2001 Drobinski
6,467,107 B1 10/2002 Glover et al.
6,503,018 B1 * 1/2003 Hou et al. ..... 403/97
6,510,568 B1 * 1/2003 Drobinski et al. ..... 5/93.1
6,516,823 B1 2/2003 Glover et al.
6,682,252 B1 * 1/2004 Battey et al. ..... 403/84
6,711,780 B1 * 3/2004 Lee ..... 16/326
2004/0216277 A1 * 11/2004 Beaver ..... 16/324

* cited by examiner

*Primary Examiner*—Robert Canfield
(74) *Attorney, Agent, or Firm*—Barnes & Thornburg LLP

(57) ABSTRACT

According to the present disclosure, a playyard top rail includes a left rail and a right rail mounted to pivot about a pivot axis relative to the right rail. The playyard top rail further includes a rail lock associated with the left and right rails. The rail lock is configured to lock the right rail to the left rail upon movement of the left and right rails to an in-line erected position and movement of the rail lock in a first direction along the pivot axis to a rail-locking position. Once the rail lock is moved in an opposite second direction along the pivot axis to a rail-releasing position, the left and right rails are free to pivot relative to one another about the pivot axis to assume a side-by-side collapsed position. An extensible cord is coupled at one end to the left rail and at another end to the right rail and supported in the middle on a lock housing containing the rail lock to define a bowed fabric support overlying a portion of the left and right rails.

50 Claims, 9 Drawing Sheets

TOP RAIL LOCK FOR PLAYYARD

BACKGROUND AND SUMMARY

The present disclosure relates to a juvenile playyard, and particularly, to a collapsible frame for a juvenile playyard. More particularly, the present disclosure relates to a collapsible playyard frame including top rails, floor support rails, and feet for elevating and supporting a floor mat in a juvenile playyard.

According to the present disclosure, a playyard top rail includes a left rail and a right rail mounted to pivot about a pivot axis relative to the right rail. The playyard top rail further includes a rail lock associated with the left and right rails.

In an illustrative embodiment, the rail lock is configured to lock the right rail to the left rail upon movement of the left and right rails to an in-line erected position and movement of the rail lock in a first direction along the pivot axis to a rail-locking position. Once the rail lock is moved in an opposite second direction along the pivot axis to a rail-releasing position, the left and right rails are free to pivot relative to one another about the pivot axis to assume a side-by-side collapsed position.

A drive spring is coupled to the rail lock and biased normally to urge the rail lock to assume the rail-locking position. A lock actuator is mounted on a lock housing containing the rail lock and is movable to urge the rail lock against the drive spring to assume the rail-releasing position so that relative pivotable movement of the left and right rails is allowed.

Also in an illustrative embodiment, an extensible cord is coupled at one end to the left rail and at another end to the right rail and supported in the middle on a lock housing containing the rail lock to define a bowed fabric support overlying a portion of the left and right rails. A left cord-shield wing is coupled to the left rail at a left pivot post for pivotable movement relative to the left rail about a left pivot axis. A right cord-shield wing is coupled to the right rail at a right pivot post for pivotable movement relative to the right rail about a right pivot axis. The left cord-shield is arranged normally to cover a first portion of the extensible cord and lie between that first portion and a portion of the fabric covering the extensible cord. Likewise, the right cord-shield is arranged normally to cover a second portion of the extensible cord and lie between that second portion and another portion of the fabric covering the extensible cord.

Additional features of the disclosure will become apparent to those skilled in the art upon consideration of the following detailed description of an illustrative embodiment exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
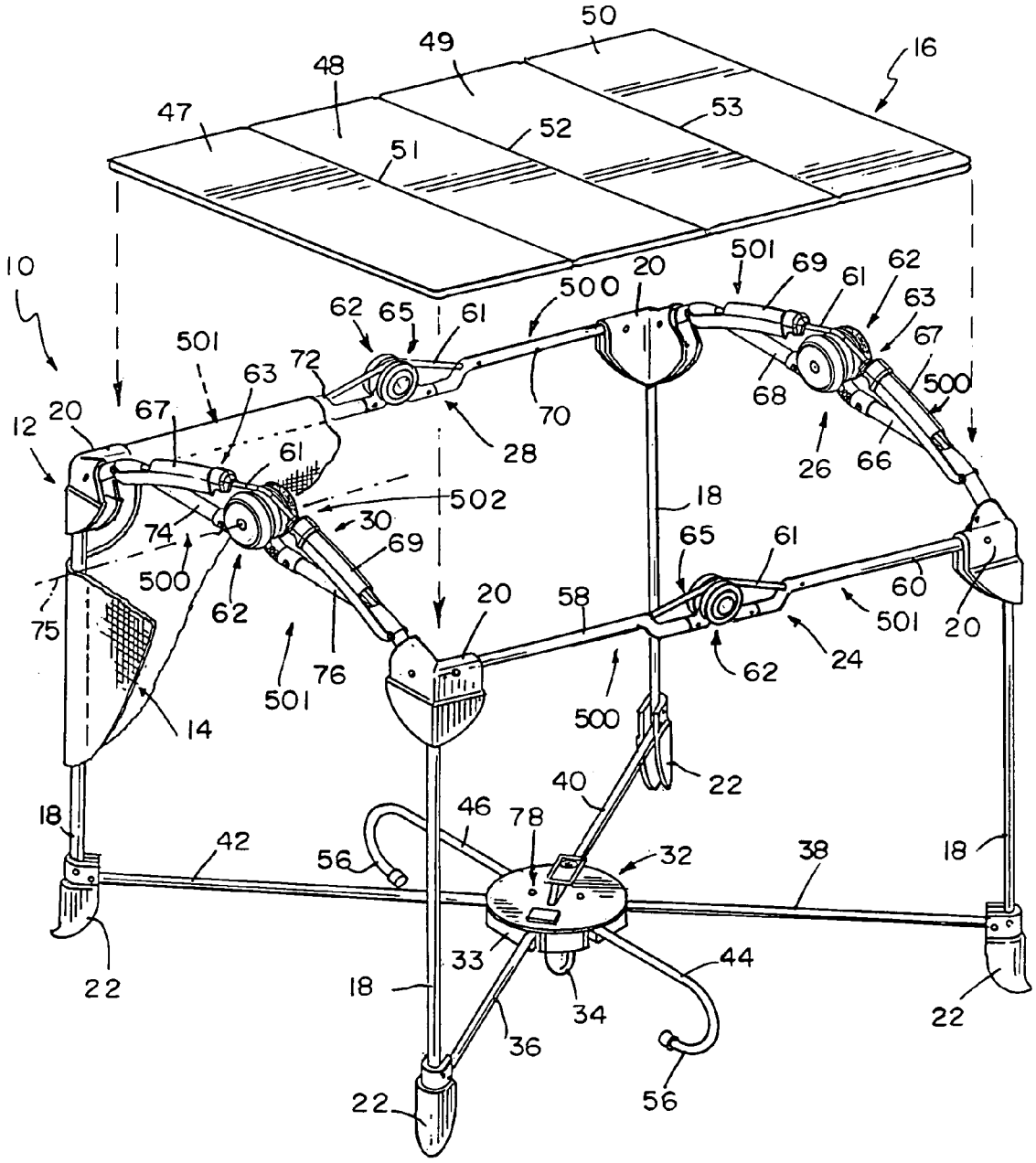
FIG. 1 is a perspective view of a collapsible playyard including a frame in accordance with the present disclosure, a fabric frame cover, and a floor mat for installation in the frame, the frame including four top rails and each top rail includes a central top rail lock.

Playyard 10 includes a collapsible frame 12, fabric frame cover 14, and removable floor mat 16. Frame cover 14 is made of sturdy fabric and netting material and is foldable to enable frame 12 to be moved easily from an erected configuration shown in FIGS. 1–4 to a collapsed configuration shown in FIGS. 6–8. Floor mat 16 is removed from frame 12 (as shown in FIG. 1) prior to collapsing frame 12. Once frame 12 is collapsed, the four-segment floor mat 16 can be folded, "wrapped" around collapsed frame 12, and secured using straps (not shown) to provide a "case" for storing and/or carrying collapsed frame 12.

Collapsible frame 12 includes four corner legs 18, a corner piece 20 at the top end of each corner leg 18, and a corner foot 22 at the bottom end of each corner leg 18. Frame 12 also includes a foldable top rail 24, 26, 28, or 30 interconnecting each pair of adjacent corner pieces 20. Each top rail includes a left rail 501 coupled to a right rail 500 for pivotable movement about a pivot axis as suggested in FIG. 1.

Frame 12 further includes a rail mount 32 and a floor support rail 36, 38, 40, or 42 interconnecting rail mount 32 and each of the corner feet 22. Rail mount 32 includes a hub receiver 33 and a foot 34 for elevating hub receiver 33 above the ground 54 underlying rail mount 32. Frame 12 also includes two auxiliary support rails 44, 46 coupled to rail mount 32.

Floor mat 16 includes four sections 47, 48, 49, and 50 arranged in series as shown in FIG. 1. Section 47 is coupled to section 48 at fold line 51, section 48 is coupled to section 49 at fold line 52, and section 49 is coupled to section 50 at fold line 53. Floor mat 16 can be "unrolled" to assume the flat configuration shown in FIG. 1 and then dropped in place to provide a sturdy playyard floor supported in an elevated position above the ground 54 underlying playyard 10 by rail mount 32 and support rails 36, 38, 40, 42, 44, and 46.

Figure 6:
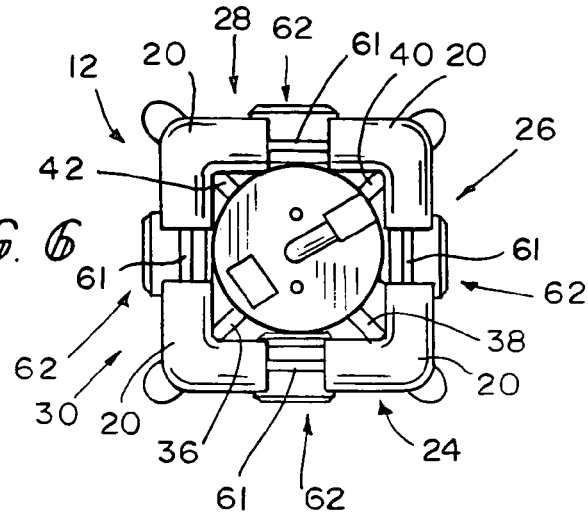
FIG. 6 is a top plan view of the playyard of FIG. 2 after the floor mat has been removed and the playyard frame has been fully collapsed.
Figure 7:
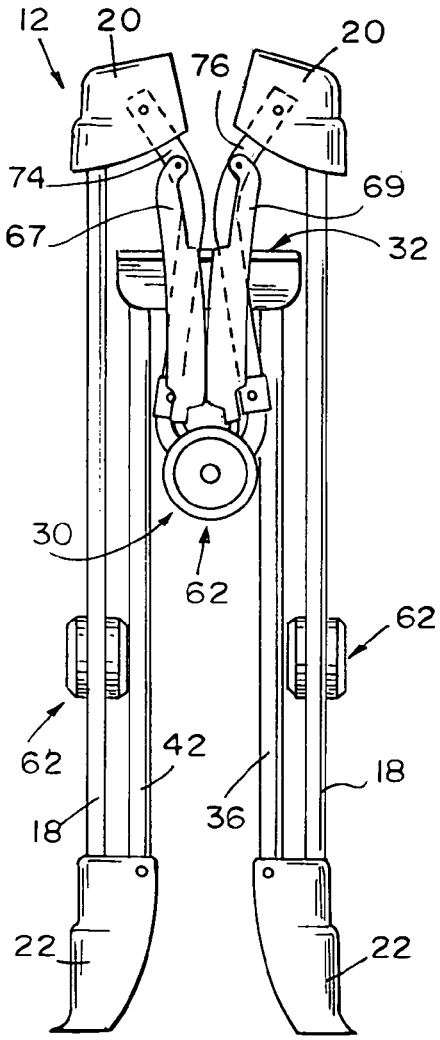
FIG. 7 is a side elevation view of the fully collapsed playyard frame of FIG. 6 showing one of the top rails on an "end" of the playyard frame in an unlocked collapsed position.
Figure 8:
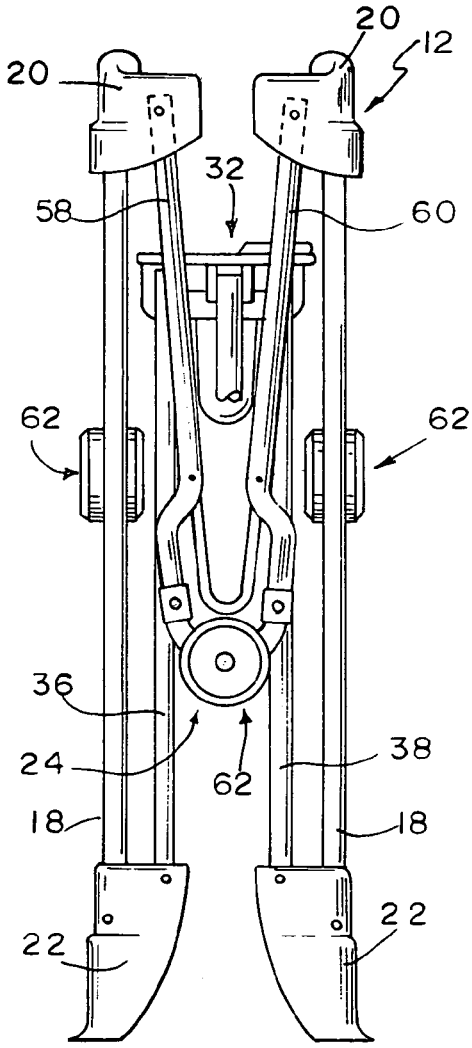
FIG. 8 is an end elevation view of the fully collapsed playyard frame of FIG. 6 showing one of the top rails on a "side" of the playyard frame in an unlocked collapsed position.

Each of support rails 36, 38, 40, and 42 has an outer end pivotably coupled to one of the corner feet 22 and an inner end arranged for pivotable movement relative to rail mount 32 so as to facilitate collapsing movement of frame 12 from its erected configuration shown in FIGS. 1–4 to its collapsed configuration shown in FIGS. 6–8. Each of auxiliary support rails 44 and 46 has an inner end pivotably coupled to rail mount 32 and an outer end formed to define a rail support foot 56 as shown, for example, in FIGS. 1 and 4. Once assembled, support rails 36, 38, 40, and 42 are arranged to lie in an X-shaped pattern, auxiliary support rail 44 is arranged to bisect the included angle defined by support rails 36 and 38, and auxiliary support rail 46 is arranged to bisect the included angle defined by support rails 40 and 42.

Left-side top rail 30 includes a left rail segment 74 pivotably coupled to one of the corner pieces 20, a right rail segment 76 coupled for pivotable movement relative to left rail segment 74 (in, for example, the manner described below) and to an adjacent corner piece 20, and a lockable rail segment hinge 62 configured to interconnect the left and right rail segments 74, 76 and to support right rail segment 76 for pivotable movement relative to left rail segment 74 about a pivot axis 75. Lockable rail segment hinge 62 is configured to "lock" the left and right rail segments 74, 76 together in an in-line erected relation one to another as shown, for example, in FIGS. 1–4 upon movement of frame 12 to its erected configuration.

Each of front top rail 24, right-side top rail 26, and rear top rail 28 is similar in structure to left-side top rail 30 in that each includes a lockable rail segment hinge 62. Front top rail 24 includes a left rail segment 58 pivotably coupled to one of the corner pieces 20 and rigidly coupled to one portion of a second rail segment hinge 62 and a right rail segment 60 pivotably coupled to one of corner pieces 20 and rigidly coupled to another portion of the second rail segment hinge 62. Right-side top rail 26 includes a left rail segment 66 pivotably coupled to one of the corner pieces 20 and rigidly coupled to one portion of a third rail segment hinge 62 and a right rail segment 68 pivotably coupled to an adjacent corner piece 20 and rigidly coupled to another portion of the third rail segment hinge 62. Rear top rail 28 includes a left rail segment 70 pivotably coupled to one of the corner pieces 20 and rigidly coupled to one portion of a fourth rail segment hinge 62 and a right rail segment 72 pivotably coupled to an adjacent corner piece 20 and rigidly coupled to another portion of the fourth rail segment hinge 62.

Figure 3:
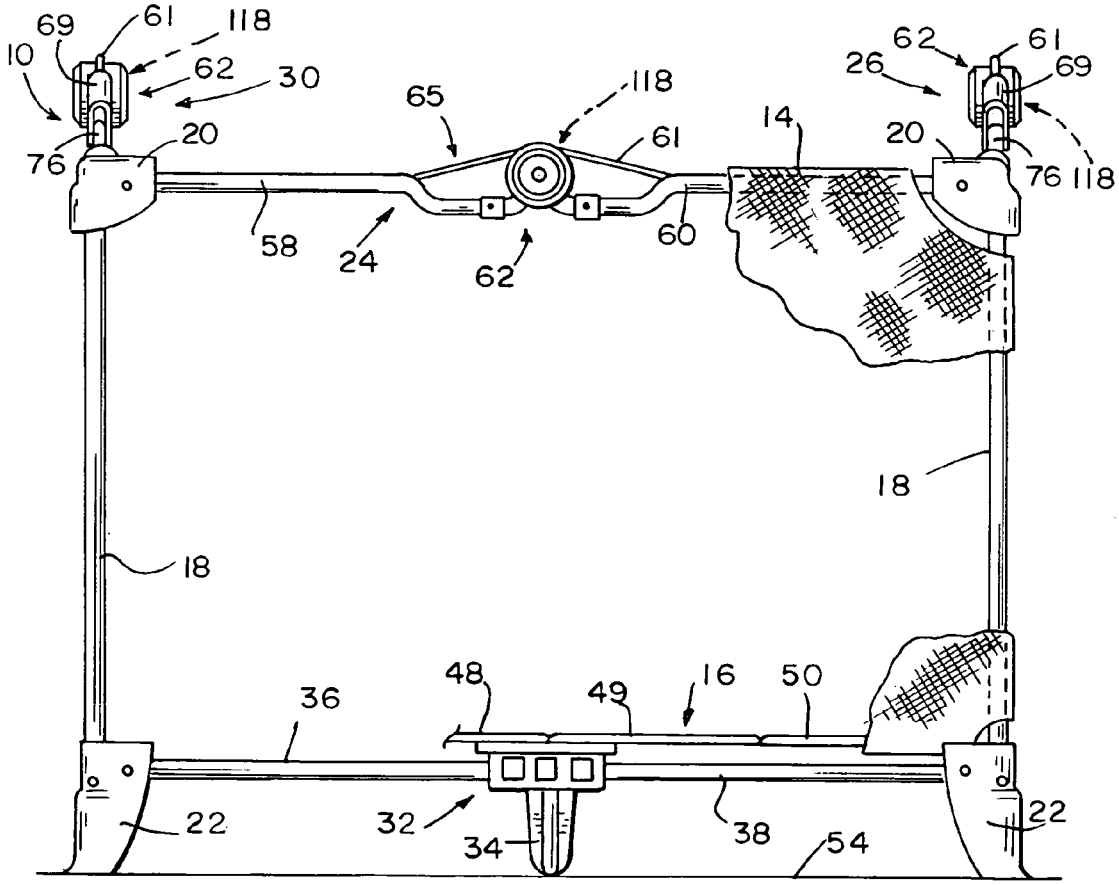
FIG. 3 is a side elevation view of the playyard of FIG. 2 showing a foot appended to the underside of a hub receiver included in the rail mount to support the hub receiver in an elevated position above the ground underlying the floor mat.
Figure 4:
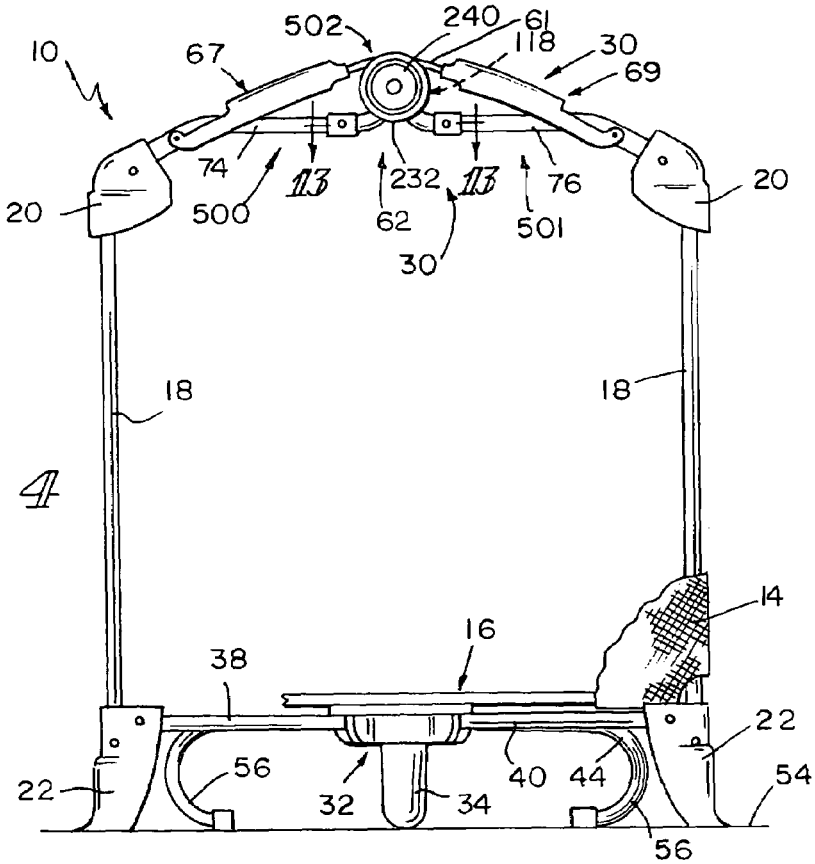
FIG. 4 is an end elevation view of the playyard of FIGS. 2 and 3 showing the top rail in its locked "in-line" erected position.
Figure 9:
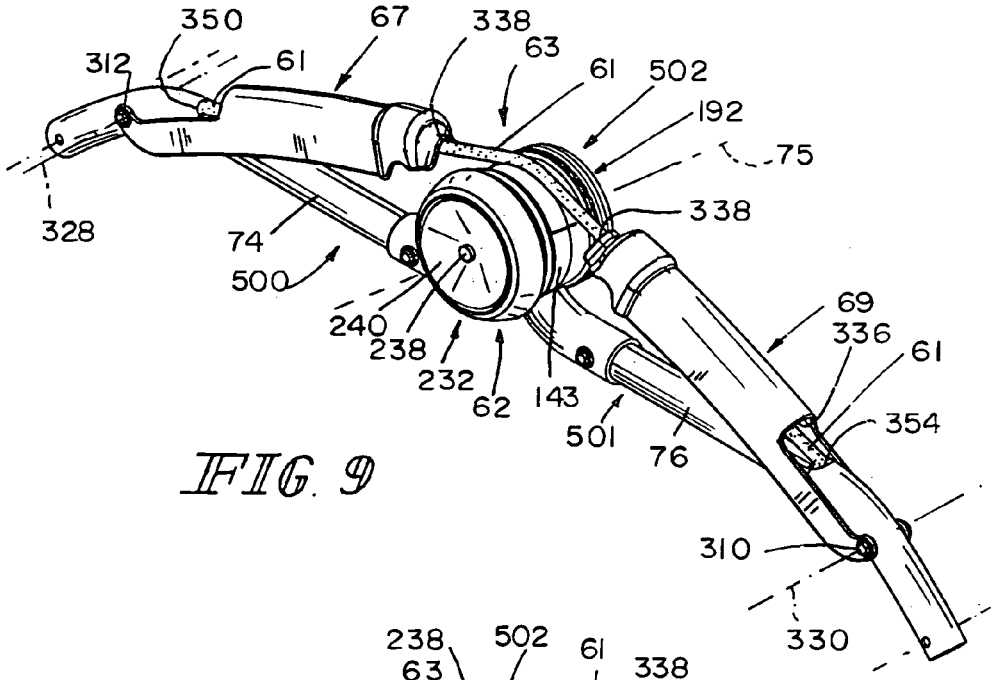
FIG. 9 is an enlarged perspective view of the top rail included on the left end of the playyard of FIG. 1 showing a lockable rail segment hinge interconnecting left and right rail segments included in the top rail, an extensible cord coupled at one end to the left rail segment and at another end to the right rail segment and tensioned to engage an outer surface of the rail segment hinge, and left and right pivotable cord-shield wings positioned to cover portions of the extensible cord.
Figure 10:
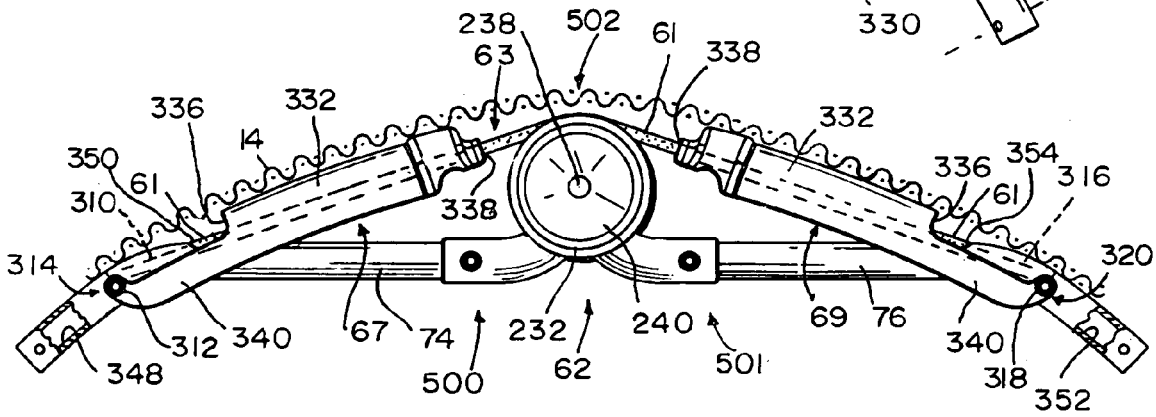
FIG. 10 is a side elevation view of the top rail of FIG. 9.

In accordance with one perspective of each of top rails 30, 24, 26, 28, it can be said that each top rail includes a left rail 500 and a right rail 501 coupled to left rail 500 for pivotable movement to left rail 500 about pivot axis 75 as suggested in FIGS. 1 and 4. A rail segment lock 118 is mounted for movement in a lock compartment 502 defined cooperatively by left and right rails 500, 501 as suggested in FIGS. 2–5, 13, and 15. Lock compartment 502 contains rail lock 118 and includes an exterior surface arranged to engage extensible cord 61 as shown, for example, in FIG. 9. As shown in FIGS. 9 and 10, extensible cord 61 is coupled at one end to left rail 500 and at another end to right rail 501 and is supported on at least one of left and right rails 500, 501 to define a bowed fabric support overlying a portion of left and right rails 500, 501.

Figure 11:
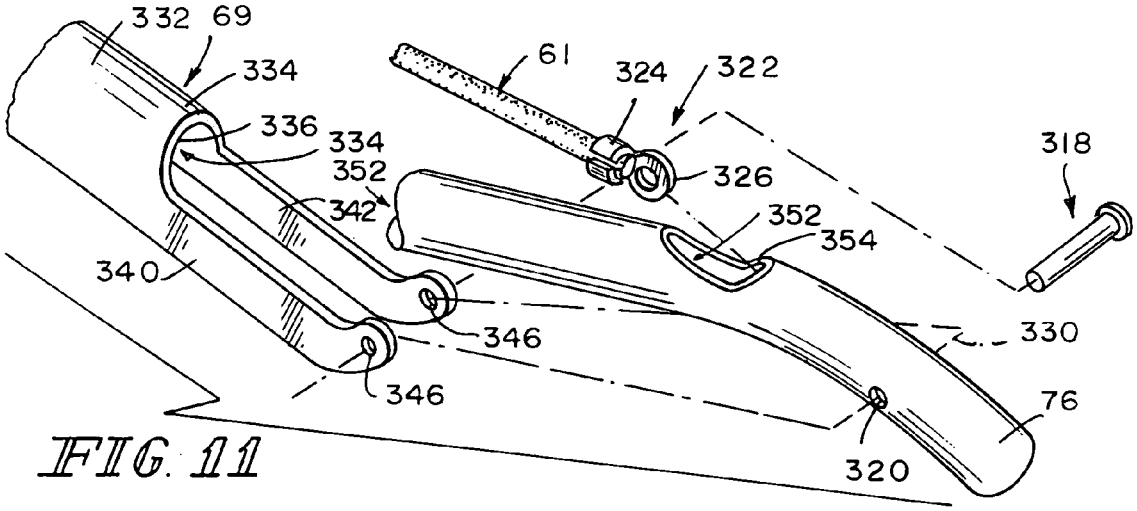
FIG. 11 is an exploded perspective view of a portion of the top rail of FIGS. 9 and 10 showing a pivot post adapted to extend through post receiver apertures formed in the right rail segment and the right pivotable cord-shield wing to support the wing for movement relative to the right rail segment about a pivot axis and to anchor one end of the extensible cord in a cord-receiving passageway formed in the right rail segment.

A fabric support 63 is coupled to each of left-side and right-side top rails 30, 26 as suggested in FIGS. 1–4 and is shown in more detail in FIGS. 9–11. Fabric support 63 comprises an extensible cord 61 and pivotable left and right cord-shields 67 and 69 configured to cover exposed portions of extensible cord 61. Fabric support 63 functions to provide a curved or bowed foundation for that portion of fabric 14 covering the associated left-side or right-side top rail 30, 26 when frame 12 is moved to assume its erected configuration as suggested in FIG. 1. Thus, in this environment, a central portion of extensible cord 61 engages an exterior surface (e.g., curved exterior plate 111 of left rail 500 and curved plate 143 of right rail 501 of a lock compartment 502 defined by left and right rails 500, 501 to tension extensible cord 61. Fabric support 63 folds along with its associated top rail 30, 26 when frame 12 is moved to assume its collapsed configuration as suggested in FIGS. 5–7.

Figure 2:
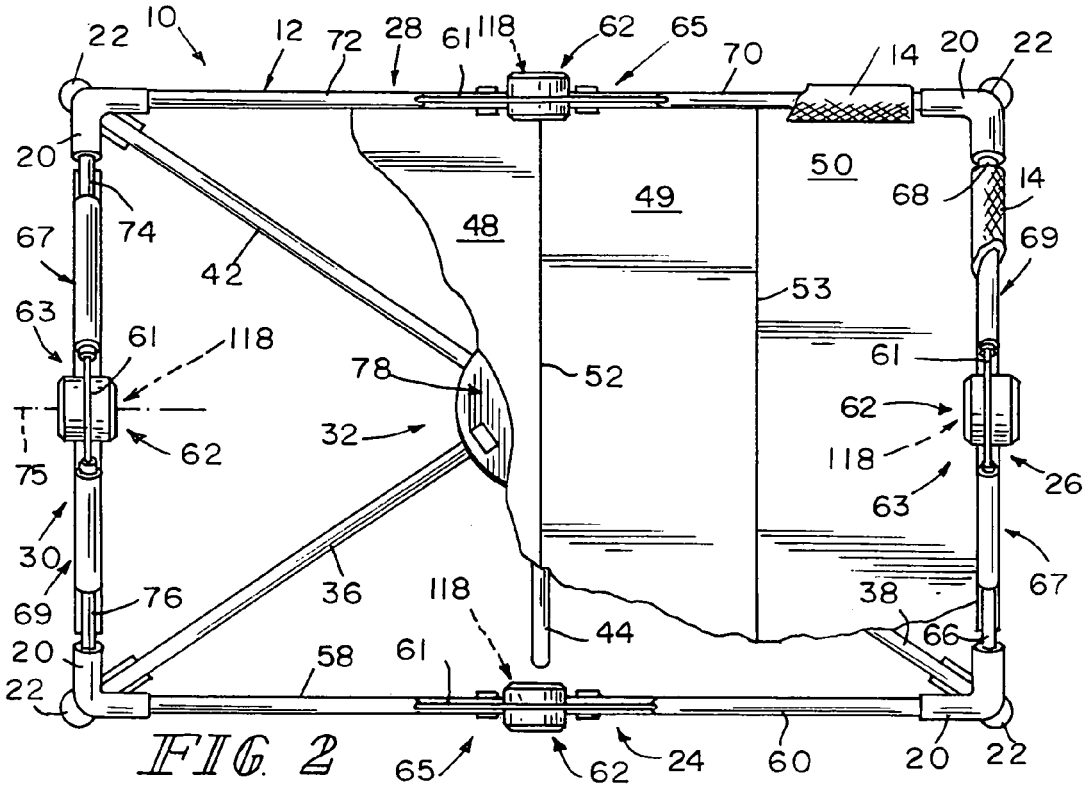
FIG. 2 is a top plan view of the playyard of FIG. 1, with portions broken away, showing an arrangement of six support rails pivotably coupled to a rail mount and positioned to underlie and support the floor mat now installed in the frame and showing four top rails arranged in a rectangular pattern above and around the support rails, each top rail including left and right rail segments and a releasable segment lock therebetween.

A fabric support 65 is coupled to each of front and rear top rails 24, 28 as suggested in FIGS. 1–3. Fabric support 65 comprises an extensible cord 61 arranged to extend over rail segment hinge 62 to provide a foundation for that portion of fabric 14 covering the associated front or rear top rail 24, 28. Thus, in this environment, a central portion of extensible cord 61 engages an exterior surface of a lock compartment 502 defined by left and right rails 500, 501 to tension extensible cord 61.

A releasable rail lock apparatus 78 is provided in rail mount 32 and configured to lock rail locks included in certain of the support rails 36, 38, 40, 42 to rail mount 32 when frame 12 is in its erected configuration as shown in FIG. 1. In the illustrated embodiment, rail lock apparatus 78 is configured to engage rail locks included in each of support rails 36, 40 to lock support rails 36, 40 to rail mount 32 when frame 12 is in its erected configuration as shown in FIG. 1 so as to prevent collapsing movement of frame 12 to its collapsed configuration. Rail lock apparatus 78 is configured to be releasable so that a user, after first removing floor mat 16 to expose rail mount 32, can manually actuate rail lock apparatus 78 to disengage a locked connection established between rail mount 32 and support rails 36, 40, thereby allowing pivoting movement of the now unlocked support rails 36, 40 relative to rail mount 32 as shown, for example, in FIG. 5 during controlled collapse of frame 12.

Figure 5:
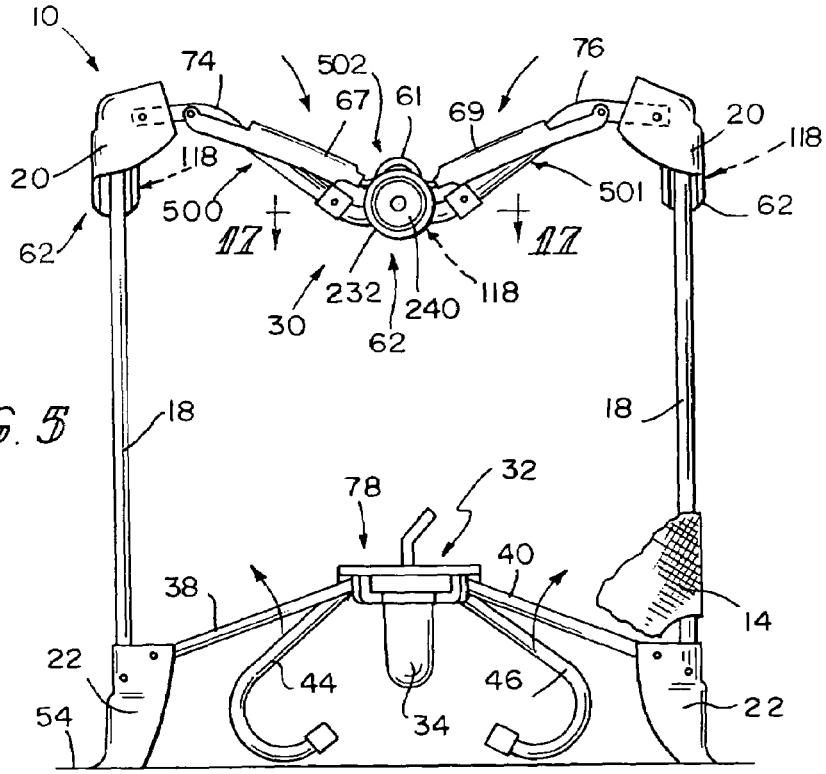
FIG. 5 is a view similar to FIG. 4 of the playyard as it is being collapsed and following unlocking of the rail mount from certain of the pivotable support rails and upward movement of the rail mount away from the ground underlying the playyard (and pivoting movement of the support rails relative to the rail mount) and then release of the segment locks in each of four top rails to allow relative movement of left and right rail segments in each of the four top rails toward collapsed positions.

Referring now to FIGS. 1 and 5, playyard 10 can be collapsed by removing floor mat 16, manually actuating releasable rail lock apparatus 78 and then raising rail mount 32 away from ground 54 to collapse support rails 36, 38, 40, 42, 44, 46 partially, and then manually actuating each of the four releasable segment locks 118 in hinges 62 to collapse top rails 24, 26, 28, 30 partially. Then frame 12 can be collapsed further to assume a fully collapsed configuration shown, for example, in FIGS. 6–8. Finally, if desired, floor mat 16 can be wrapped around collapsed frame 12 and secured using suitable means to provide a storage case or carrying case for collapsed frame 12.

The fabric support 63 associated with the left-side top rail 30 is shown in more detail in FIGS. 9–11. Extensible cord 61 is coupled at one end 310 to a pivot post 312 mounted in a post receiver aperture 314 formed in left rail segment 74 as suggested in FIG. 10. Extensible cord 61 is coupled at another end 316 to a pivot post 318 mounted in a post receiver aperture 320 formed in right rail segment 76 as suggested in FIGS. 10 and 11. In the illustrated embodiment, a post connector 322 including a cord clamp 324 and a post-receiving eyelet 326 is used to couple extensible cord 61 to its companion pivot post, e.g., 318, as suggested in FIG. 11.

As suggested in FIGS. 9 and 10, left cord-shield wing 67 is coupled to left rail segment 74 at pivot post 312 for pivotable movement about a left pivot axis 328 and right cord-shield wing 69 is coupled to right rail segment 76 at pivot post 318 for pivotable movement about right pivot axis 330. Each of wings 67, 69 includes an elongated shell 332 formed to include a cord-receiving passageway 334, a rear cord opening 336, and a front opening 338 as suggested in FIGS. 9–11. Each of wings 67, 69 also includes a pair of spaced-apart parallel post arms 340, 342 extending from a rear end 344 of shell 332 to receive a portion of one of the left and right rail segments 74, 76 therebetween. Each post arm 340, 342 is formed to include a post aperture 346 sized to receive a portion of one of pivot posts 312, 318 therein to support each of cord-shield wings 67, 69 for pivotable movement about a pivot axis relative to its associated rail segment 74 or 76.

As suggested in FIGS. 9 and 10, left rail segment 74 is formed to include a left rail passageway 348 therein and a left cord exit aperture 350 opening into the left rail passageway 348. Left pivot post 312 extends laterally through left rail passageway 348 to provide an anchor in passageway 348 for extensible cord 61. As suggested in FIG. 10, extensible cord 61 extends away from pivot post 312 and passes first through left cord exit aperture 350 and then through the cord-receiving passageway formed in shell 332 of left cord-shield wing 67.

As suggested in FIGS. 9–11, right rail segment 76 is formed to include a right rail passageway 352 therein and a right cord exit aperture 354 opening into right rail passageway 352. Right pivot post 318 extends laterally through right rail passageway 352 to provide an anchor in passageway 352 for extensible cord 61. As suggested in FIGS. 10 and 11, extensible cord 61 extends away from pivot post 318 and passes first through right cord exit aperture 354 and then through cord-receiving passageway 334 formed in shell 332 of right cord-shield wing 69.

Figure 12:
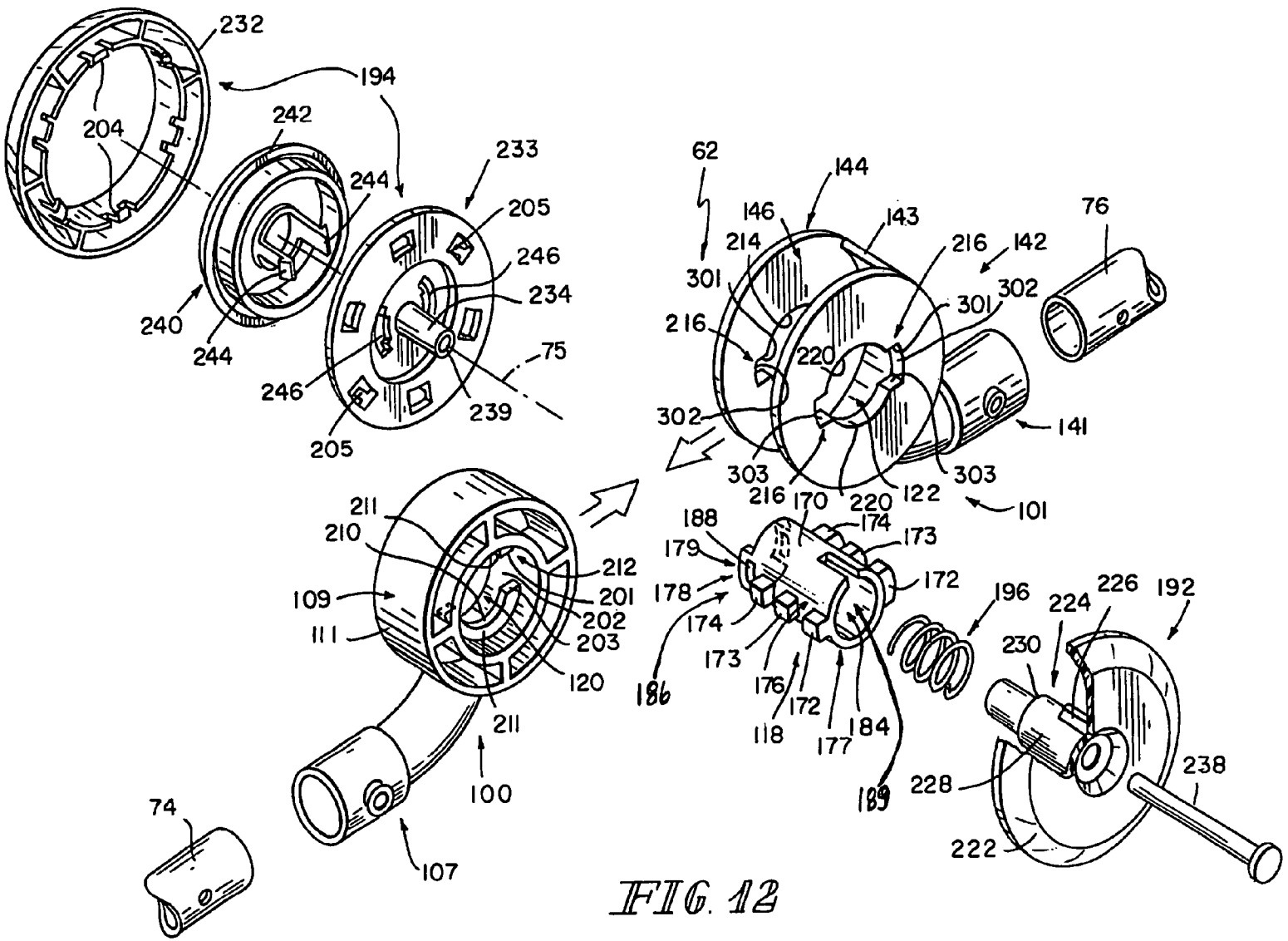
FIG. 12 is an exploded perspective view of components included in the lockable rail segment hinge shown in FIGS. 9 and 10, which components cooperate to support the right rail segment for pivoting movement relative to the left rail segment as suggested in FIG. 5 and to provide a push-button-actuated locking mechanism associated with the left and right rail segments, the components including (from left to right) an outer hub shell, a "button-style" lock actuator, an outer hub base comprising a hub plate and a mounting post, a hinge base adapted to be coupled to the left rail segment, a hinge yoke adapted to be coupled to the right rail segment and mate with the hinge base, a tubular rail segment lock, a coiled drive spring, an inner hub comprising a shell and a guide post, and a connector.
Figure 17:
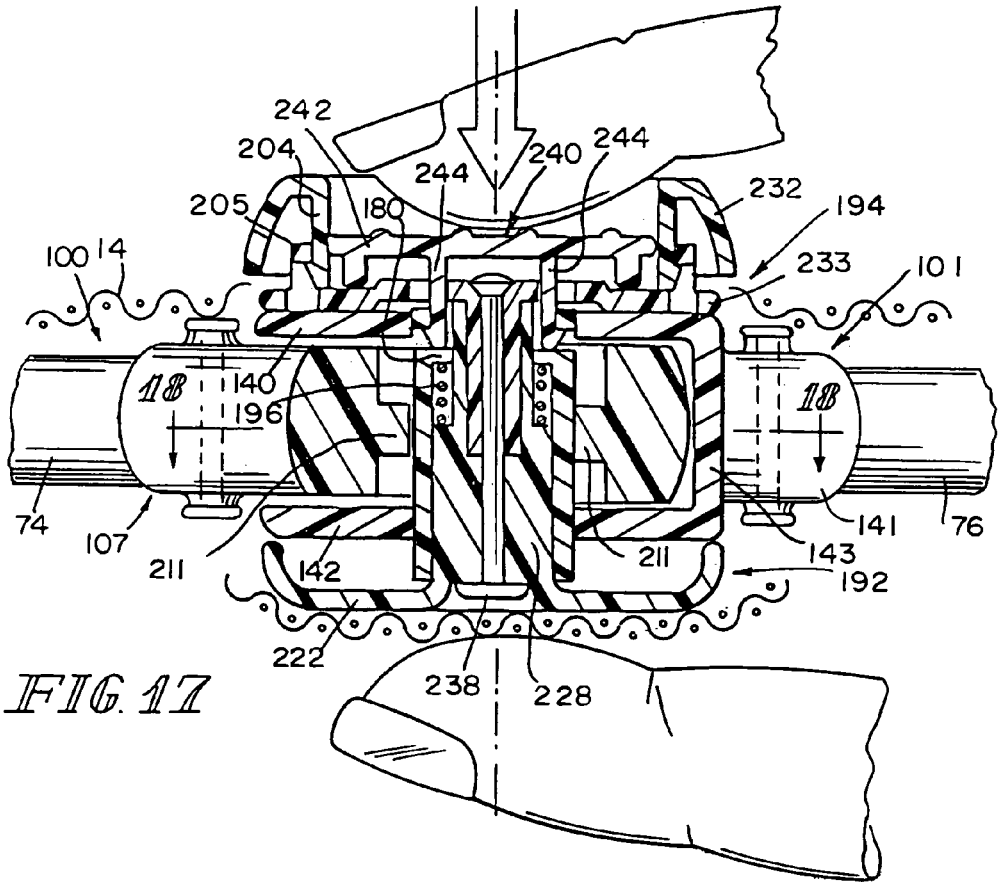
FIG. 17 is a sectional view taken along line 17—17 of FIG. 5 showing pivotable movement of the right rail segment relative to the left rail segment while the tubular rail segment lock remains in a rail segment-unlocking position.
Figure 18:
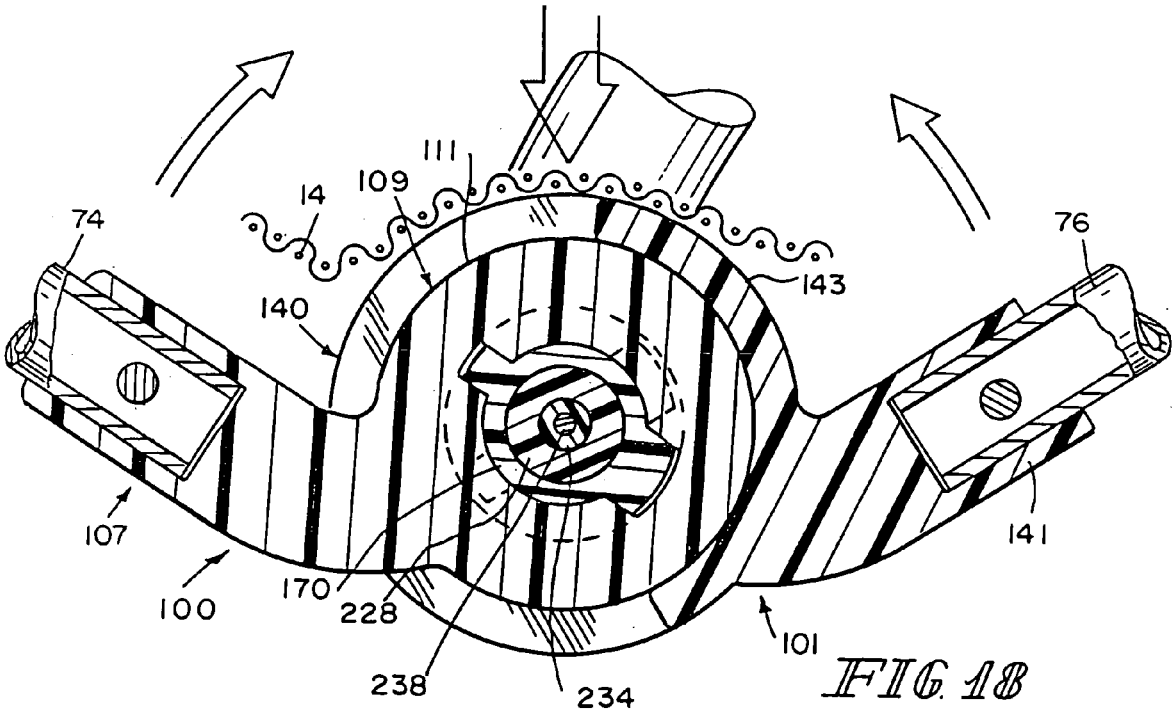
FIG. 18 is a sectional view taken along line 18—18 of FIG. 17.

The components that cooperate to form lockable rail segment hinge 62 in the illustrated embodiment are shown in FIG. 12. Each of top rails 24, 26 28, and 30 includes a lockable rail segment hinge 62 as suggested in FIG. 1. Rail segment locking and unlocking functions associated with one of these lockable rail segment hinges 62 is shown, for example, in FIGS. 13–18. In particular, rail segment hinge 62 is shown in a "locked" position in FIGS. 13 and 14 to retain the left and right rail segments 74, 76 in left-side top rail 30 in an "in-line" erected position that is associated with movement of playyard frame 12 to an erected configuration as shown in FIGS. 1–4. Next, rail segment hinge 62 is shown in an "unlocked" position in FIGS. 15 and 16 so as to permit pivotable movement of right rail segment 76 relative to left rail segment 74 about pivot axis 75 of the type that must occur to allow the playyard frame 12 to be collapsed as suggested in FIG. 5. Finally, in FIGS. 17 and 18, rail segment hinge 62 is shown in the unlocked position during the early stage of collapse of playyard frame 12 that is shown in FIG. 5.

Figure 13:
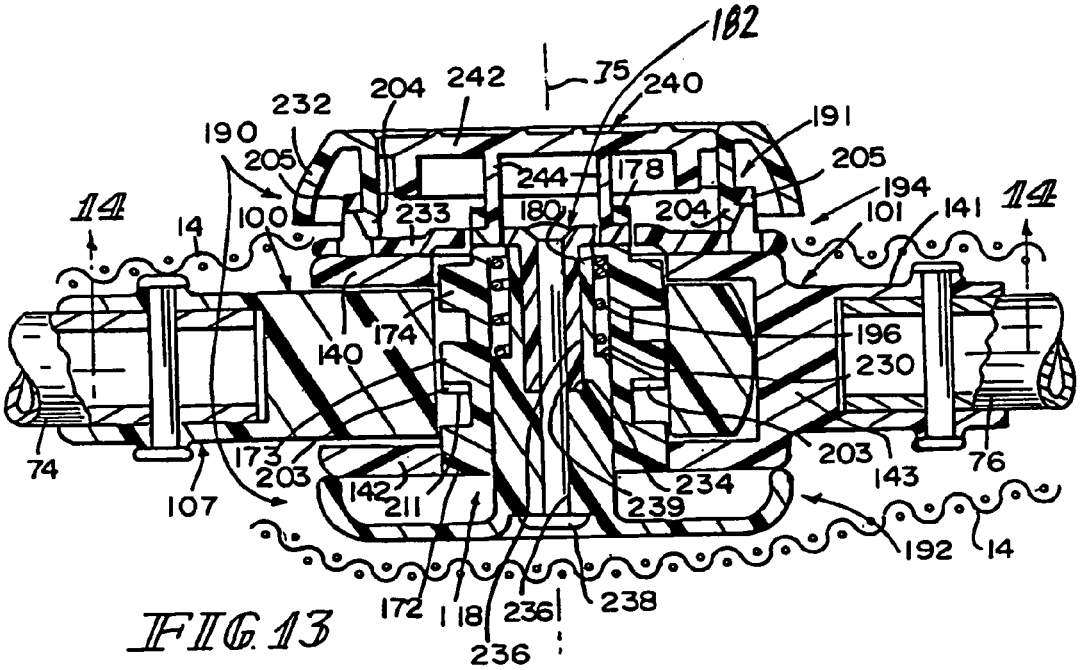
FIG. 13 is a sectional view taken along line 13—13 of FIG. 4 showing the tubular rail segment lock in a rail segment-locking position.
Figure 14:
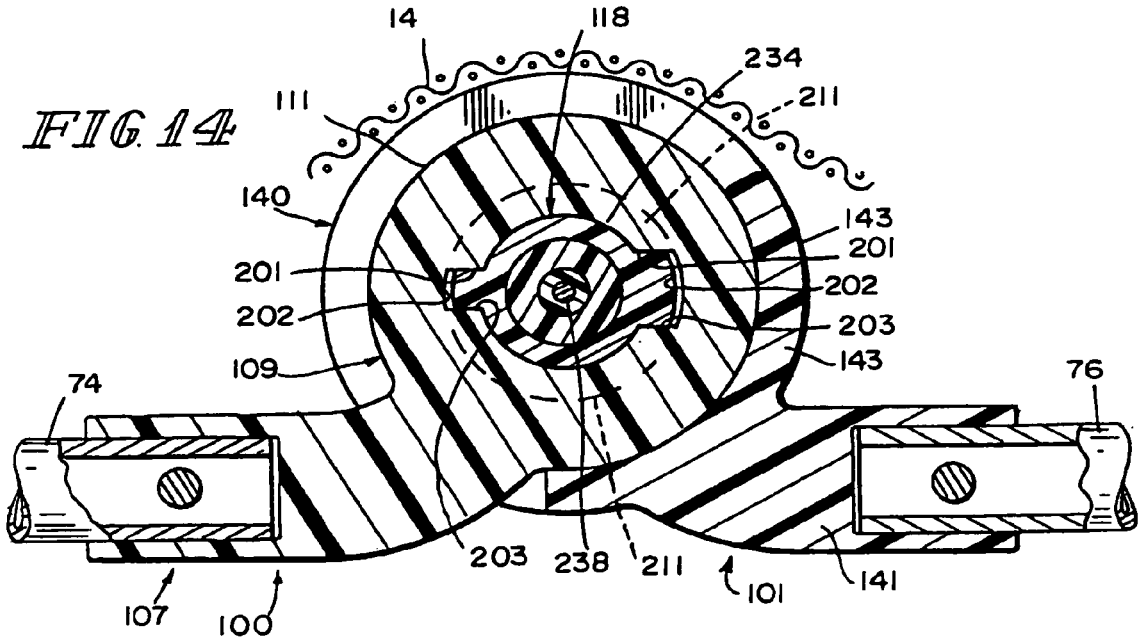
FIG. 14 is a sectional view taken along line 14—14 of FIG. 13.

As suggested in FIG. 12, rail segment hinge 62 includes a hinge base 100 coupled to left rail segment 74 and a hinge yoke 101 coupled to right rail segment 76. Hinge base 100 includes a segment mount 107 adapted to be coupled to left rail segment 74 as shown in FIGS. 12–14 and a lock mount 109 appended to segment mount 107 and formed to include a curved exterior plate 111 as shown in FIG. 12. Hinge yoke 101 is configured to receive and mate with hinge base 100 and move relative to hinge base 100 as suggested in FIGS. 13–18 during relative pivoting movement of left and right rail segments 74, 76 about pivot axis 75.

A rail segment lock 118 is also included in rail segment hinge 62 as suggested in FIG. 12. Rail segment lock 118 is configured to be mounted for movement in passageways formed in hinge base 100 and hinge yoke 101 between a segment-locking position shown, for example, in FIGS. 13 and 14 and a segment-releasing position shown, for example, in FIGS. 15 and 16. In the segment-locking position, rail segment lock 118 engages hinge base 100 and hinge yoke 101 to block pivotable movement of right rail segment 76 relative to left rail segment 74. In the segment-releasing position, rail segment lock 118 engages hinge base 100 but is disengaged from hinge yoke 101 to allow pivotable movement of right rail segment 76 relative to left rail segment 74 about pivot axis 75.

A rail segment lock 118 shown, for example, in FIG. 12, is provided in each rail segment hinge 62 and is configured to extend through passageways 120, 122 (also shown in FIG. 12) formed in hinge base 100 and hinge yoke 101. Hinge base 100 and hinge yoke 101 are supported on companion rail segment lock 118 for pivotable movement about its pivot axis 75 as shown, for example, in FIGS. 13–18.

Each rail segment lock 118 is constrained to move back and forth along pivot axis 75 between (1) a rail segment-locking position (shown in FIGS. 13 and 14) to engage hinge base 100 and its companion hinge yoke 101 to block movement of that hinge yoke 101 relative to hinge base 100 and (2) a rail segment-releasing position (shown in FIGS. 15–18) to disengage that hinge base 100 to allow movement of that hinge yoke 101 relative to hinge base 100 about armrest pivot axis 75. As described below, passageways 120, 122 formed in hinge base 100 and hinge yoke 101 are configured so that each rail segment lock 118 is able to move along pivot axis 75 to assume its rail segment-locking position only when the left and right rail segments 74, 76 have been pivoted about pivot axis 75 to assume the in-line erected position shown in FIGS. 1–4, 13, and 14.

In an illustrative embodiment, hinge yoke 101 includes an inner segment support plate 142 formed to include a portion of passageway 122 and an outer segment support plate 144 formed to include another portion of passageway 122. Hinge yoke 101 also includes a segment mount 141 adapted to mate with right segment rail 76 and a curved plate 143 appended to segment mount 141 and arranged to interconnect plates 142, 144 as shown, for example, in FIGS. 12–14 to fix plates 142, 144 in spaced-apart parallel relation to one another. Lock mount 109 of hinge base 100 is sized to fit into a space 146 provided between inner and outer segment support plates 142, 144 when rail segment hinge 62 is assembled.

A mechanism is provided for locking hinge yoke 101 to hinge base 100 whenever left and right rail segments 74, 76 are moved to assume the in-line position shown in FIG. 1. An actuator is provided for unlocking hinge yoke 101 at the option of a user whenever the user desires to pivot hinge yoke 101 (and right rail segment 76) relative to hinge base 100 (and left rail segment 74).

In an illustrative embodiment shown in FIG. 12, rail segment lock 118 is somewhat tubular and includes a barrel 170, inner lugs 172 provided on one end of barrel 170, outer lugs 174 provided near an opposite end of barrel 170, and middle lugs 173 located on barrel 170 in positions between inner and outer lugs 172, 174. An annular inner bearing 176 is provided on an exterior surface of barrel 170 and arranged to extend through spaces provided between companion pairs of inner and middle lugs 172, 173. An annular outer bearing 178 is provided on an exterior surface of outer end 179 of barrel 170. Barrel 170 is formed to include an interior partition 180 formed to include a connector passage hole 182 and a post-receiving chamber 184 lying between interior partition 180 and an inner end 177 of barrel 170. Chamber 184 is sized to receive a drive spring 196 and a guide post 224 shown, for example, in FIG. 12 and described in more detail below.

Axially extending curved flanges 186 are formed in outer end 179 of barrel 170 and arranged to lie in circumferentially spaced-apart relation to one another. A pair of finger-receiving apertures 188 is formed in barrel 170 so that each aperture 188 lies in a space between an outer lug 174 and its companion flange 186 and interrupts the portion of the exterior surface of barrel 170 defining annular outer bearing 178. An axially extending guide slot 189 is formed in barrel 170 to have an opening in inner end 177 and is sized to receive an anti-rotation lug 226 shown, for example, in FIG. 12 and described below.

As shown, for example, in FIG. 13, lock housing 190 comprising inner hub 192 and outer hub 194 is configured to provide an interior region 191 containing outer segment support plate 144, hinge base 100, inner segment support plate 142, and rail segment lock 118. A drive spring 196 is also contained in interior region 191 of lock housing 190. Drive spring 196 is located and biased relative to inner hub 192 to urge rail segment lock 118 along pivot axis 75 to assume its rail segment-locking position whenever left and right rail segments 74, 76 are moved to assume the in-line erected position shown in FIGS. 1, 13, and 14.

Passageway 120 formed in hinge base 100 is defined to receive rail segment lock 118 and allow rail segment lock 118 to move back and forth along an axis (such as pivot axis 75) as it moves between rail segment-locking and rail segment-releasing positions. Hinge base 100 is formed to include a barrel channel 210 and a pair of lug slots 212 lying on "opposite sides" of barrel channel 210 and having openings into barrel channel 210 as shown, for example, in FIGS. 12, 14, 16, and 18. Barrel channel 210 and lug slots 212 cooperate to define passageway 120 as barrel channel 210 is sized to receive and support barrel 170 of rail segment lock 118 and each lug slot 212 is sized to receive and support inner, middle, and outer lugs 172, 173 on barrel 170 as rail segment lock 118 moves back and forth along pivot axis 75. Rotation of rail segment lock 118 about pivot axis 75 during axial movement of rail segment lock 118 along pivot axis 75 is blocked because of the placement of lugs 172, 174 in lug slots 212.

In an illustrative embodiment, each lug slot 212 formed in hinge base 100 is defined by a U-shaped wall comprising three serially arranged segments 201, 202, 203 as shown, for example, in FIGS. 12 and 14. A boundary of barrel channel 210 is defined by two opposing arcuate segments 211 having concave surfaces arranged to face one another and positioned to lie in a space between the U-shaped walls defining the lug slots 212. Opposite ends of one of arcuate segments 211 provide segments 201 and opposite ends of the other of arcuate segments 211 provide segments 203 as shown best in FIG. 14.

Figure 15:
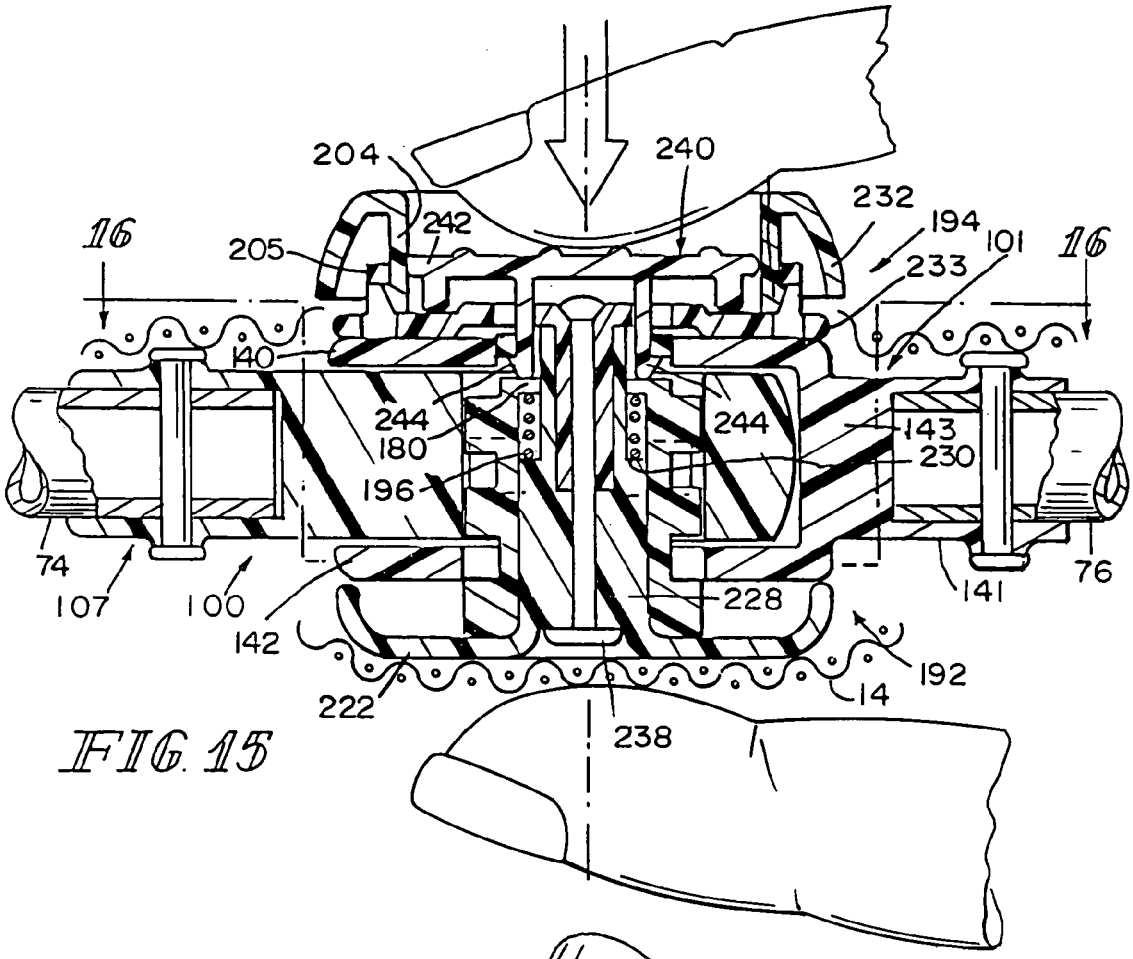
FIG. 15 is a sectional view similar to FIG. 13 showing the tubular rail segment lock in a rail segment-unlocking position.
Figure 16:
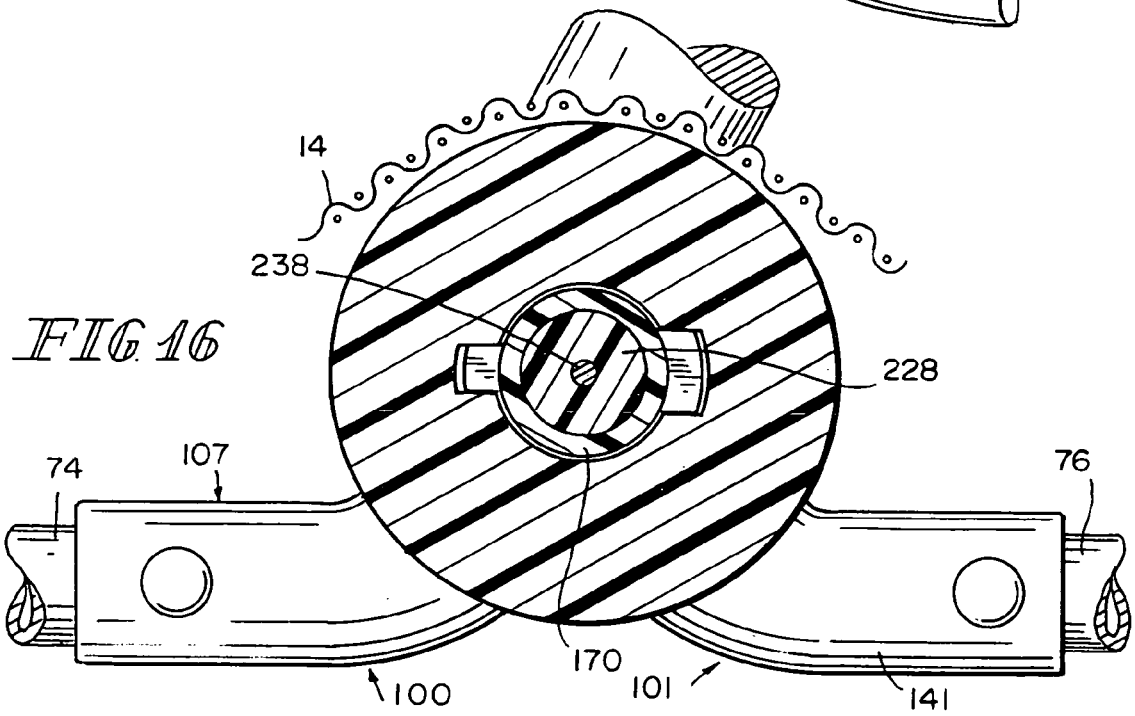
FIG. 16 is a sectional view taken along line 16—16 of FIG. 15.

Passageway 122 formed in each segment support plate 142, 144 is defined to receive rail segment lock 118 when it is in the rail segment-releasing position as shown, for example, in FIGS. 15 and 16. Each segment support plate 142, 144 is formed to include a barrel receiver 214 and two opposing lug receivers 216 having openings into barrel receiver 214. These receivers 214 and 216 cooperate to define passageway 122 as barrel receiver 214 is sized to receive and support barrel 170 of rail segment lock 118 and each lug receiver 216 is sized to receive and support either an inner lug 172 or an outer lug 174 provided on barrel 170.

In an illustrative embodiment, each lug receiver 216 formed in a segment support plate 142, 144 is defined by a U-shaped wall comprising three serially arranged segments 301, 302, 303 as shown, for example, in FIG. 12. A boundary of barrel receiver 214 is defined by an interior journal comprising two curved surfaces 220 (see FIG. 12) separated from one another and arranged to share a center of curvature positioned to lie along pivot axis 75.

When hinge base 100 and hinge yoke 101 are rotated about pivot axis 75 relative to one another, rail segment lock 118 will have been moved to its armrest-releasing position as shown, for example, in FIGS. 15 and 16 and the two curved surfaces 210 included in inner segment support plate 142 will lie in rotative bearing engagement with annular inner bearing 176 provided on the exterior surface of barrel 170 (near inner end 177) and the two curved surfaces 220 included in outer segment support plate 144 will lie in rotative bearing engagement with annular outer bearing 178 provided on the exterior surface of barrel 170 (near outer end 179). Each set of two curved surfaces 220 provide an "interior journal" in one of the segment support plates 142, 144 to support those segment support plates 142, 144 for rotation about pivot axis 75 during relative pivoting movement of hinge base 100 and hinge yoke 101. It is within the scope of this disclosure to use one or more other surfaces in each segment support plate 142, 144 to provide such an interior journal.

Inner hub 192 comprises a shell 222 and a guide post 224 appended to an interior surface of shell 222 as shown best in FIGS. 12 and 13. Guide post 224 is sized to extend into the chamber 184 formed in barrel 170. Guide post 224 is configured to support barrel 170 as barrel 170 slides in barrel channel 210 during movement of rail segment lock 118 between the rail segment-locking and rail segment-releasing positions.

An anti-rotation lug 226 is appended to a cylindrical outer surface 228 of guide post 224 as shown, for example, in FIG. 12. Anti-rotation lug 226 is movable in the axially extending guide slot 189 formed in barrel 170 to block rotation of inner hub 192 about pivot axis 75 without blocking sliding movement of barrel 170 along pivot axis 75 as rail segment lock 118 moves between the rail segment-locking and rail segment-releasing positions.

Drive spring 196 is located in chamber 184 formed in barrel 170 of rail segment lock 118. One end of drive spring 196 is positioned to engage interior partition or spring support 180 and an opposite end of drive spring 196 is positioned to engage an annular, axially outwardly facing surface 230 on an outer end of guide post 224. Drive spring 196 is biased yieldably to urge rail segment lock 118 on guide post 224 toward the rail segment-locking position shown in FIGS. 13 and 14 so that rail segment lock 118 will be moved to that rail segment-locking position whenever left and right rail segments 72, 74 are moved to the in-line erected position shown in FIG. 1. Inner hub 192 and drive spring 196 cooperate to define lock mover means for yieldably urging rail segment lock 118 to assume the rail segment-locking position in the manner just described.

Outer hub 194 comprises a shell 232, a hub plate 233, and a mounting post 234 appended to an interior surface of hub plate 233 as shown, for example, in FIGS. 12 and 13. Anchor fingers 204 included in shell 232 mate with anchor fingers 205 included in hub plate 233 to anchor shell 232 in a fixed position on hub plate 233 as shown, for example, in FIG. 13. Mounting post 234 is sized to pass into a post-receiving aperture 236 formed in guide post 224 of inner hub 192. A connector 238 can be passed through aperture 236 to engage an aperture 239 formed in mounting post 234 so as to lock inner and outer hubs 192, 194 together as a unit to form lock housing 190.

A lock actuator 240 is coupled to rail segment lock 118 and mounted for movement on lock compartment 190 to move barrel 170 against a biasing force generated by drive spring 196 so as to move rail segment lock 118 to assume the rail segment-releasing position when left and right rail segments 72, 74 are moved to the in-line erected position. Lock actuator 240 includes a button 242 located outside lock compartment 190 and a pair of actuator fingers 244 coupled to button 242 as shown, for example, in FIGS. 12 and 13. Each actuator finger 244 is arranged to extend through one of apertures 246 formed in hub plate 233 and into one of the finger-receiving apertures 188 formed in barrel 170. Flanges 186 provided on outer end 170 of barrel 170 also extend into apertures 246 formed in hub plate 233.

Rail segment lock 118 is moved along pivot axis 75 by drive spring 196 to block relative rotation of hinge base 100 and hinge yoke 101 about pivot axis 75 whenever left and right rail segments 72, 74 are moved to the in-line erected position. In such a position shown, for example, in FIGS. 1, 13, and 14, the two lug receivers 216 are arranged to lie in side-by-side relation to lug slots 212 formed in hinge base 100, each of inner lugs 172 on barrel 170 extends into a lug slot 212 formed in hinge base 100 and an adjacent lug receiver 216 formed in inner segment support plate 142, and each of outer lugs 174 on barrel 170 extends into a lug slot 212 formed in hinge base 100 and an adjacent lug receiver 216 formed in outer segment support plate 144. Lugs 172, 174 are located on barrel 170 to lie outside all of the lug receivers 216 formed in segment support plates 142, 144 as shown, for example, in FIG. 15 so that the interior journals (provided by curved surfaces 220) on arm support plates 142, 144 engage the bearings 176, 178 provided on barrel 170 of rail segment lock 118 to support hinge base 100 and hinge yoke 101 for relative pivotable movement about axis 75.

Although the disclosure has been described in detail with reference to certain illustrative embodiments, variations and modifications exist within the scope and spirit of the disclosure as described and defined in the following claims.

The invention claimed is:

1. A top rail of a playyard, the top rail comprising a left rail segment of the playyard, a right rail segment of the playyard, and a lockable rail segment hinge of the playyard arranged to interconnect the left and right rail segments and to support the right rail segment for pivotable movement relative to the left rail segment about a pivot axis, the rail segment hinge including a hinge base coupled to the left rail segment, a hinge yoke coupled to the right rail segment and configured to receive and mate with the hinge base and move relative to the hinge base during relative pivoting movement of the left and right rail segments about the pivot axis, and a rail segment lock mounted for movement in a passageway formed in the hinge base between a segment-locking position to engage the hinge base and hinge yoke and block pivotable movement of the right rail segment relative to the left rail segment and a segment-releasing position to disengage the hinge yoke to allow pivotable movement of the right rail segment relative to the left rail segment about the pivot axis.

2. The top rail of claim 1, wherein the hinge base is formed to include a barrel channel and a lug slot having an opening into the barrel channel and cooperating with the barrel channel to define the passageway receiving the rail segment lock therein, the hinge yoke is formed to include a barrel receiver and a lug receiver having an opening into the barrel receiver and being arranged to lie in side-by-side relation to the lug slot upon movement of the left and right rail segments to an in-line erected position, and the rail segment lock includes a barrel positioned for sliding movement in the barrel channel and barrel receiver between the segment-locking and segment-releasing positions and a lug coupled to the barrel, the lug is located to extend into both of the lug slot and the lug receiver to block pivotable movement of the right rail segment relative to the left rail segment upon movement of the left and right rail segments to the in-line erected position and movement of the barrel to the segment-locking position, and the lug is also located to extend into the lug slot and lie outside the lug receiver to allow pivotable movement of the right rail segment relative to the left rail segment about the pivot axis between the in-line erected position and a side-by-side storage position upon movement of the barrel to the segment-releasing position.

3. The top rail of claim 2, further comprising lock mover means for yieldably urging the rail segment lock to assume the segment-locking position upon movement of the left and right rail segments about the pivot axis to assume the in-line erected position.

4. The top rail of claim 3, further comprising a lock housing formed to include an interior region containing the rail segment lock therein and a lock actuator coupled to the barrel and mounted for movement on the lock housing to move the barrel against a biasing force generated by the lock mover means so as to move the rail segment lock to assume the segment-releasing position when the left and right rail segments occupy the in-line erected position.

5. The top rail of claim 3, wherein the lock mover means includes a hub configured to support the rail segment lock as the segment lock moves back and forth along the pivot axis between the segment-locking position and the segment-releasing position and a drive spring engaged at one end to the hub and at an opposite end to the rail segment lock and biased yieldably to urge the rail segment lock toward the segment-locking position.

6. The top rail of claim 3, wherein the barrel is formed to include an interior wall defining a post-receiving chamber and a spring support located in the post-receiving chamber, the lock mover means includes a hub comprising a shell and a guide post coupled to the shell and arranged to extend into the post-receiving chamber and support the barrel as the barrel slides in the barrel channel during movement of the rail segment lock between the segment-locking position and the segment-releasing position, and the lock mover further includes a drive spring located in the post-receiving chamber to engage the spring support in the barrel and the guide post in the hub and biased yieldably to urge the rail segment lock toward the segment-locking position.

7. The top rail of claim 6, wherein the hub further includes an anti-rotation lug movable in an axially extending slot formed in the barrel to block rotation of the hub about the pivot axis without blocking sliding movement of the barrel along the pivot axis as the rail segment lock moves between the segment-locking and segment-releasing positions.

8. The top rail of claim 1, further comprising lock mover means for yieldably urging the rail segment lock to assume the segment-locking position only upon movement of the left and right rail segments to an in-line erected position.

9. A top rail of a playyard, the top rail comprising a left rail segment of the playyard, a right rail segment of the playyard, a lockable rail segment hinge of the playyard arranged to interconnect the left and right rail segments and to support the right rail segment for pivotable movement relative to the left rail segment about a pivot axis, the rail segment hinge including a hinge base coupled to the left rail segment, a hinge yoke coupled to the right rail segment and configured to receive and mate with the hinge base and move relative to the hinge base during relative pivoting movement of the left and right rail segments about the pivot axis, and a rail segment lock mounted for movement in a passageway formed in the hinge base between a segment-locking position to engage the hinge base and hinge yoke and block pivotable movement of the right rail segment relative to the left rail segment and a segment-releasing position to disengage the hinge yoke to allow pivotable movement of the right rail segment relative to the left rail segment about the pivot axis, and a hub configured to support the rail segment lock as the rail segment lock moves back and forth along the pivot axis between the segment-locking and segment-releasing positions and a drive spring engaged at one end to the hub and at an opposite end to the rail segment lock and biased yieldably to urge the rail segment lock toward the segment-locking position.

10. A top rail of a playyard, the top rail comprising a left rail segment of the playyard, a right rail segment of the playyard, a lockable rail segment hinge of the playyard arranged to interconnect the left and right rail segments and to support the right rail segment for pivotable movement relative to the left rail segment about a pivot axis, the rail segment hinge including a hinge base coupled to the left rail segment, a hinge yoke coupled to the right rail segment and configured to receive and mate with the hinge base and move relative to the hinge base during relative pivoting movement of the left and right rail segments about the pivot axis, and a rail segment lock mounted for movement in a passageway formed in the hinge base between a segment-locking position to encage the hinge base and hinge yoke and block pivotable movement of the right rail segment relative to the left rail segment and a segment-releasing position to disengage the hinge yoke to allow pivotable movement of the right rail segment relative to the left rail segment about the pivot axis, and wherein the rail segment lock is formed to include an interior wall defining a post-receiving chamber and a spring support located in the post-receiving chamber and the lock mover includes a hub and a drive spring located in the post-receiving chamber to engage the spring support and the hub and biased yieldably to urge the rail segment lock toward the segment-locking position.

11. The top rail of claim 10, wherein the hub comprises a shell and a guide post coupled to the shell and arranged to extend into the post-receiving chamber and support the rail segment lock as the rail segment lock moves in the passageway formed in the hinge base between the segment-locking position and the segment-releasing position and the drive spring is engaged at one end to the spring support and at an opposite end to the guide post.

12. The top rail of claim 10, further comprising an anti-rotation lug coupled to the hub and arranged to move in an axially extending slot formed in the rail segment lock to block rotation of the hub about the pivot axis as the rail segment lock moves between the segment-locking position and the segment-releasing position.

13. The top rail of claim 1, further comprising a lock housing formed to include an interior region containing the rail segment lock therein and an anti-rotation lug coupled to the lock housing and arranged to move in a slot formed in the rail segment lock to block rotation of the lock housing about the pivot axis without blocking movement of the rail segment lock along the pivot axis as the rail segment lock moves between the segment-locking position and the segment-releasing position.

14. The top rail of claim 13, further comprising a drive spring engaged at one end to the lock housing and at an opposite end to the rail segment lock and biased yieldably to urge the rail segment lock toward the segment-locking position.

15. The top rail of claim 14, further comprising a lock actuator coupled to the rail segment lock and mounted for movement on the lock housing to move the rail segment lock against a biasing force generated by the drive spring so as to move the rail segment lock to assume the segment-releasing position when the left and right rail segments occupy the in-line erected position.

16. The top rail of claim 1, further comprising an extensible cord coupled at one end to the left rail segment and at another end to the right rail segment and arranged to engage the rail segment hinge during pivotable movement of the right rail segment relative to the left rail segment about the pivot axis.

17. The top rail of claim 16, further comprising a left cord-shield wing coupled to the left rail segment at a left pivot post for pivotable movement about a left pivot axis and arranged normally to cover a first portion of the extensible cord and a right cord-shield wing coupled to the right rail segment at a right pivot post for pivotable movement relative to the right rail segment about a right pivot axis and arranged normally to cover a second portion of the extensible cord.

18. The top rail of claim 17, wherein the extensible cord further includes a central portion located between the first and second portions and arranged to engage the rail segment hinge during pivotable movement of the right rail segment relative to the left rail segment about the pivot axis.

19. The top rail of claim 17, wherein the left rail segment is formed to include a left rail passageway therein and a left cord exit aperture opening into the left rail passageway, the left pivot post extends through the left rail passageway, said one end of the extensible cord is coupled to the left pivot post in the left rail passageway, the extensible cord passes through the left cord exit aperture and then through a cord-receiving passageway formed in the left cord-shield wing, the right rail segment is formed to include a right rail passageway therein and a right cord exit aperture opening into the right rail passageway, the right pivot post extends through the right rail passageway, said another end of the extensible cord is coupled to the right pivot post in the right rail passageway, and the extensible cord passes through the right cord exit aperture and then through a cord-receiving passageway formed in the right cord-shield wing.

20. A playyard top rail comprising a left rail segment, a right rail segment, a hinge base coupled to the left rail segment and formed to include a barrel channel and a lug slot having an opening into the barrel channel, a rail segment lock including a barrel located to move in the barrel channel and inner and outer lugs coupled to the barrel for movement therewith and located to move in the lug slot, and a hinge yoke coupled to the right rail segment, the hinge yoke being mounted on the rail segment lock for movement relative to the hinge base and rotation on the rail segment lock about a pivot axis to move the right rail segment relative to the left rail segment, the hinge yoke including an inner segment support plate and an outer segment support plate positioned to lie in spaced-apart relation to the inner segment support plate to locate the hinge base in a space provided therebetween, wherein each of the inner and outer segment support plates is formed to include a barrel receiver and a lug receiver having an opening into the barrel receiver and arranged to lie in side-by-side relation to the lug slot formed in the hinge base upon movement of the right rail segment to an in-line erected position relative to the left rail segment, wherein the inner lug is located on the barrel to extend into both of the lug slot formed in the hinge base and the lug receiver formed in the inner segment support plate and the outer lug is located on the barrel to extend into both of the lug slot formed in the hinge base and the lug receiver formed in the outer segment support plate cooperatively to block further movement of the right rail segment relative to the left rail segment about the pivot axis upon movement of the right rail segment about the pivot axis to the in-line erected position and movement of the barrel in the barrel channel formed in the hinge base to a segment-locking position, and wherein each of the inner and outer lugs is located on the barrel to lie outside of the lug receivers formed in the inner and outer segment support plates to allow rotation of the right rail segment on the rail segment lock relative to the left rail segment about the pivot axis upon movement of the barrel in the barrel channel formed in the hinge base to a segment-releasing position.

21. The top rail of claim 20, wherein the inner lug is arranged to lie outside of the lug slot formed in the hinge base and the outer lug is arranged to lie inside the lug slot formed in the hinge base upon movement of the barrel to the segment-releasing position.

22. The top rail of claim 20, further comprising a lock housing being formed to include an interior region containing the hinge base, the inner and outer segment support plates, and the rail segment lock, and a lock actuator coupled to the rail segment lock and mounted on the lock housing to move the rail segment lock in the interior region of the lock housing to the segment-releasing position.

23. The top rail of claim 22, wherein the lock actuator includes a button located outside the lock housing and an actuator finger coupled to the button and arranged to extend through an aperture formed in the lock housing into an aperture formed in the barrel.

24. The top rail of claim 22, further comprising a drive spring located in the interior region of the lock housing to engage the barrel at one end and the lock housing at another end and biased to yieldably urge the barrel to the segment-locking position and the button to an unactuated position.

25. The top rail of claim 20, further comprising an anti-rotation lug coupled to the lock housing and arranged to move in a slot formed in the barrel to block rotation of the lock housing about the pivot axis as the barrel moves between the segment-locking position and the segment-releasing position.

26. The top rail of claim 16, wherein the hinge base includes an inner wall and a pair of arcuate segments arranged to lie in spaced-apart relation to one another and to cooperate with the inner wall to define the barrel channel and lug slot therebetween and the rail segment lock further includes a middle lug coupled to the barrel and arranged to lie between the inner and outer lugs to engage the arcuate segments to block rotation of the barrel relative to the hinge base about the pivot axis upon movement of the rail segment lock to the segment-locking position.

27. The top rail of claim 26, wherein the outer lug is arranged to engage the arcuate segments to block rotation of the barrel relative to the hinge base about the pivot axis upon movement of the rail segment lock to the segment-releasing position.

28. The top rail of claim 26, wherein the middle lug is arranged to engage the arcuate segments to block rotation of the barrel relative to the hinge base about the pivot axis upon movement of the rail segment lock to the segment-releasing position.

29. The top rail of claim 26, wherein the outer lug is arranged to engage the arcuate segments to block rotation of the barrel relative to the hinge base about the pivot axis upon movement of the rail segment lock to the segment-releasing position.

30. A top rail of a playyard, the top rail comprising a left rail of the playyard formed to include a passageway, a rail lock mounted for movement and being in the passageway, and a right rail of the playyard mounted for rotation around an outer circumferential surface of the rail lock about a pivot axis relative to the left rail, wherein the rail lock is constrained to move in the passageway along the pivot axis between a rail-locking position blocking rotation of the right rail about the pivot axis relative to the left rail and a rail-releasing position allowing rotation of the right rail about the pivot axis relative to the left rail.

31. The top rail of claim 30, further comprising an extensible cord coupled at one end to the left rail and at another end to the right rail, a left cord-shield wing coupled to the left rail at a left pivot post for pivotable movement relative to the left rail about a left pivot axis and arranged normally to cover a first portion of the extensible cord, and a right cord-shield wing coupled to the right rail at a right pivot post for pivotable movement relative to the right rail about a right pivot axis and arranged normally to cover a second portion of the extensible cord.

32. The top rail of claim 31, wherein the left rail is formed to include a left rail passageway therein and a left cord exit aperture opening into the left rail passageway, the left pivot post extends through the left rail passageway, said one end of the extensible cord is coupled to the left pivot post in the left rail passageway, and the extensible cord passes through the left cord exit aperture and then through a cord-receiving passageway formed in the left cord-shield wing.

33. The top rail of claim 32, wherein the right rail is formed to include a right rail passageway therein and a right cord exit aperture opening into the right rail passageway, the right pivot post extends through the right rail passageway, said another end of the extensible cord is coupled to the right pivot post in the right rail passageway, and the extensible cord passes through the right cord exit aperture and then through a cord-receiving passageway formed in the right cord-shield wing.

34. The top rail of claim 31, wherein the left and right rails cooperate to form a lock compartment containing the rail lock and including an exterior surface and a central portion of the extensible cord engages the exterior surface of the lock compartment to tension the extensible cord.

35. The top rail of claim 34, wherein the left cord-shield wing terminates at a left cord outlet positioned to lie in spaced-apart relation to the left pivot post, the right cord-shield wing terminates at a right cord outlet positioned to lie in spaced-apart relation to the right pivot post, and the lock compartment is arranged to lie in a space located between the left and right cord outlets upon pivotable movement of the left and right cord-shield wings to engage the extensible cord.

36. A playyard top rail comprising a left rail, a right rail coupled to the left rail for pivotable movement relative to the left rail about a pivot axis, a rail lock mounted for movement relative to the left and right rails between a rail-locking position blocking rotation of the right rail about the pivot axis relative to the left rail and a rail-releasing position allowing rotation of the right rail about the pivot axis relative to the left rail, and an extensible cord coupled at one end to the left rail and at another end to the right rail and supported on at least one of the left and right rails to define a bowed fabric support overlying a portion of the left and right rails.

37. The top rail of claim 36, further comprising a left cord-shield wing coupled to the left rail at a left pivot post for pivotable movement about a left pivot axis and arranged normally to cover a first portion of the extensible cord and a right cord-shield wing coupled to the right rail at a right pivot post for pivotable movement relative to the right rail about a right pivot axis and arranged normally to cover a second portion of the extensible cord.

38. The top rail of claim 37, wherein the left rail is formed to include a left rail passageway therein and a left cord exit aperture opening into the left rail passageway, the left pivot post extends through the left rail passageway, said one end of the extensible cord is coupled to the left pivot post in the left rail passageway, and the extensible cord passes through the left cord exit aperture and then through a cord-receiving passageway formed in the left cord-shield wing.

39. The top rail of claim 38, wherein the right rail is formed to include a right rail passageway therein and a right cord exit aperture opening into the right rail passageway, the right pivot post extends through the right rail passageway, said another end of the extensible cord is coupled to the right pivot post in the right rail passageway, and the extensible cord passes through the right cord exit aperture and then through a cord-receiving passageway formed in the right cord-shield wing.

40. The top rail of claim 36, wherein the left and right rails cooperate to form a lock compartment containing the rail lock and including an exterior surface and a central portion of the extensible cord engages the exterior surface of the lock compartment to tension the extensible cord.

41. The top rail of claim 40, wherein the left cord-shield wing terminates at a left cord outlet positioned to lie in spaced-apart relation to the left pivot post, the right cord-shield wing terminates at a right cord outlet positioned to lie in spaced-apart relation to the right pivot post, and the lock compartment is arranged to lie in a space located between the left and right cord outlets upon pivotable movement of the left and right cord-shield wings to engage the extensible cord.

42. A top rail for a playyard, the top rail comprising a pair of rail segments of the playyard, each rail segment being connected at a first end to the playyard, a lockable rail segment hinge interconnecting second ends of the rail segments, a fabric cover of the playyard arranged to overlie and at least partially cover the pair of rail segments, and a pair of support wings of the playyard, each support wing having a first end associated with and pivotably connected to one of the rail segments at a spaced-apart distance from the lockable rail segment hinge and a second end located proximate to the lockable rail segment hinge and overlying the associated rail segment, and each support wing being positioned to underlie and provide support for the fabric cover when the playyard is moved to an erected position.

43. The top rail of claim 42, wherein each support wing second end is free to move relative to the lockable rail segment hinge.

44. The top rail of claim 42, wherein each support wing includes an elongated shell formed to include a passageway to accommodate a portion of its associated rail segment.

45. The top rail of claim 42, wherein each support wing includes a pair of spaced-apart parallel post arms extending from a rear end of the elongated shell and configured to receive a portion of its associated rail segment.

46. The top rail of claim 45, wherein each post arm is formed to include an aperture sized to receive a portion of a pivot post therein to support each support wing for pivotable movement about a pivot axis relative to its associated rail segment.

47. A top rail of a playyard, the top rail comprising a pair of rail segments of the playyard, a lockable rail segment hinge of the playyard arranged to interconnect the pair of rail segments and to support one of the rail segments for pivotable movement relative to the other rail segment, a fabric cover of the playyard arranged to overlie and cover the pair of rail segments, and a support wing associated with and coupled to each of the rail segments for pivotable movement relative to its associated rail segment about a pivot axis, each support wing being positioned to lie between the fabric cover and the associated rail segment and positioned to extend from the pivot axis toward the lockable rail segment hinge.

48. The top rail of claim 47, wherein when the support wing includes a distal end pivotably coupled to its associated rail segment and a proximal end covering at least a portion of a cavity formed between the lockable rail segment hinge and the associated rail segment.

49. A top rail of a playyard, the top rail comprising a left rail segment and a right rail segment of the playyard, each rail segment having first and second ends, a fabric cover of the playyard arranged to overlie and cover the left and right rail segments, a lockable rail segment hinge of the playyard arranged to interconnect the second ends of the left and right rail segments at a location displaced from a top of the lockable rail segment hinge thereby creating a space defined between a straight line extension of the first end of each rail segment ending at the top of the lockable rail segment hinge and the second end connected at the lockable rail segment hinge, and a support wing associated with and coupled to each of the left and right rail segments for movement of each support wing relative to its associated rail segment, each support wing positioned to cover the space and to lie between the fabric cover and the associated rail segment.

50. A top rail of a playyard, the top rail comprising a left rail segment and a right rail segment of the playyard, a lockable rail segment hinge of the playyard arranged to interconnect the left and right rail segments and to support the right rail segment for pivotable movement relative to the left rail segment about a first pivot axis, a fabric cover of the playyard overlying the left and right rail segments, a support wing associated with and pivotably coupled to each of the left and right rail segments, each support wing configured to include an elongated shell to provide a foundation for at least a portion of the fabric cover overlying the left and right rail segments when the playyard is in to an erected position.

* * * * *